US008127920B2

(12) United States Patent
Hageman

(10) Patent No.: US 8,127,920 B2
(45) Date of Patent: Mar. 6, 2012

(54) GREETING CARD PACKAGING AND FRAME BOX STRUCTURES

(75) Inventor: Joel T. Hageman, Lakewood, OH (US)

(73) Assignee: American Greetings Corp., Cleveland, OH (US)

( * ) Notice: Subject to any disclaimer, the term of this patent is extended or adjusted under 35 U.S.C. 154(b) by 59 days.

(21) Appl. No.: 12/709,849

(22) Filed: Feb. 22, 2010

(65) Prior Publication Data

US 2011/0048978 A1 Mar. 3, 2011

Related U.S. Application Data

(60) Provisional application No. 61/154,039, filed on Feb. 20, 2009.

(51) Int. Cl.
*B65D 85/00* (2006.01)
*B65D 85/62* (2006.01)

(52) U.S. Cl. ..... 206/215; 206/449

(58) Field of Classification Search ..... 206/215, 206/449, 576, 224, 424, 425, 451, 776, 497, 206/499
See application file for complete search history.

(56) References Cited

U.S. PATENT DOCUMENTS 1,053,601 A * 2/1913 Hitchcock ..... 206/770
1,871,617 A * 8/1932 King ..... 206/215
2,021,860 A * 11/1935 Kelly ..... 229/239
2,478,635 A * 8/1949 Overly ..... 206/215
2,551,390 A * 5/1951 Overly ..... 206/215
2,655,260 A * 10/1953 Clerc ..... 206/232
2,670,074 A * 2/1954 Golden ..... 206/215
2,742,145 A * 4/1956 Blackburn et al. ..... 206/449
2,960,219 A * 11/1960 Bielan ..... 206/215
3,055,494 A * 9/1962 Hepp ..... 206/561
3,483,967 A * 12/1969 Versh ..... 206/215
3,648,833 A * 3/1972 Dash ..... 206/215
3,963,167 A * 6/1976 Newgaard, II ..... 206/425
3,973,674 A * 8/1976 Postlethwaite ..... 206/215
7,284,663 B2 10/2007 Madigan
7,627,967 B1 12/2009 Torvik

FOREIGN PATENT DOCUMENTS

WO WO2006002524 1/2006

* cited by examiner

*Primary Examiner* — Steven A. Reynolds
(74) *Attorney, Agent, or Firm* — Roetzel & Andress

(57) ABSTRACT

Greeting card package constructs and containers for the retail packaging and sale of sets of greeting cards with envelopes, including a frame box structure configured to hold a plurality or set of greeting cards and having openings in front and back panels to make at least two or more pages of a greeting card in the package visible, and substantially reducing total material requirements for the package. The package structure includes four sides and four back flanges to hold the greeting cards in place. One embodiment of the disclosure is capable of holding one set of identical greeting cards. Another embodiment is capable of holding two side-by-side sets of separate identical greeting cards. The package is wrapped in cellophane to preserve both the front and inside views of the greeting card.

6 Claims, 6 Drawing Sheets

GREETING CARD PACKAGING AND FRAME BOX STRUCTURES

RELATED APPLICATIONS

This patent claims priority to Provisional Patent Application No. 61/154,039 filed on Feb. 20, 2009, which is incorporated herein by reference.

FIELD OF THE INVENTION

The present disclosure pertains generally to containers or packaging for the retail sale of a set of greeting cards, and more particularly to frame box type packages capable of holding a plurality of greeting cards and of displaying the front cover and inside verse of greeting cards.

BACKGROUND OF THE INVENTION

Greeting cards are often sold in sets of between ten and fifty cards. Most often, each card in the set is identical. Purchasing a set of identical greeting cards is popular around the holidays, especially the Christmas holiday when consumers send a multitude of greeting cards to family and friends. Buying in bulk lots avoids having to search and select a single greeting card for each person for which you intend to send a greeting. The most common way in which a set of greeting cards is packaged for sale is in a cardboard box that may depict the front of the greeting card on the front of the cardboard box. In order to view the actual card and the inside verse, the consumer must, if able, open the box and remove one of the greeting cards. Although the cardboard box may be a practical way to package greeting cards, consumers may prefer to actually see the actual card and inside verse before purchasing said cards, and this is difficult to do with a closed or sealed box.

SUMMARY OF THE INVENTION

A greeting card package assembly of the present disclosure and related inventions us capable of holding a multitude of stacked identical greeting cards packaged for retail sale. The frame box contains a top and bottom panel, two parallel side panels, a back top and bottom flange, and two back side flanges configured to surround edges of a stack or plurality of cards. The flanges located at the back of the frame box are what holds the greeting cards while still allowing the inside sentiment to show through the back of the frame box. Once the cards are inserted into the frame box, the frame box is covered in cellophane or other transparent material in the form of a sleeve or cover or encapsulation to hold an protect the cards within the frame and to enable viewing of both the front page and interior page of the greeting card. The assembly is capable of housing a single set of identical greeting cards with the front cover visible through the open front of the frame box and the inside verse visible through the substantially open back of the frame box. The assembly may also house two sets of identical greeting cards where the front cover of one set is shown through the open front and the front cover of the other set is shown through the substantially open back. Another embodiment can house two sets of identical greeting cards in a side by side arrangement where the front covers of each set are shown through the open front of the frame and the inside verses are shown through the substantially open back. Alternatively, four sets of identical greeting cards may be arranged such that two sets are arranged in a side by side arrangement with the front covers showing through the open front of the frame and the other two sets are arranged in a side by side arrangement with the front covers showing through the substantially open back of the frame.

The frame box has many advantages over the traditional card box. One improvement is that the consumer can view the actual front of the greeting card and also the inside verse without opening the package. Another improvement relates to the material savings that is created by accomplishing the same task, namely holding and displaying greeting cards for retail sale, using much less material given that the frame box has no front or back panels. The frame box also reduces the amount of scrap produced in the manufacturing and production of the product. The term "frame box" as used herein refers to a structure having four adjoining side panels operatively connected to four flanges with an open front and a substantially open back. The lack of a conventional box structure with four side walls and a closed bottom also satisfies certain environmental initiatives which seek to eliminate production of closed boxes or containers which tend to collect and preserve garbage and trash when deposited in a land fill.

These and other aspects of the disclosure and related inventions are further described herein in exemplary forms with reference to the accompanying drawing figures.

DETAILED DESCRIPTION OF PREFERRED AND ALTERNATE EMBODIMENTS

Figure 2:
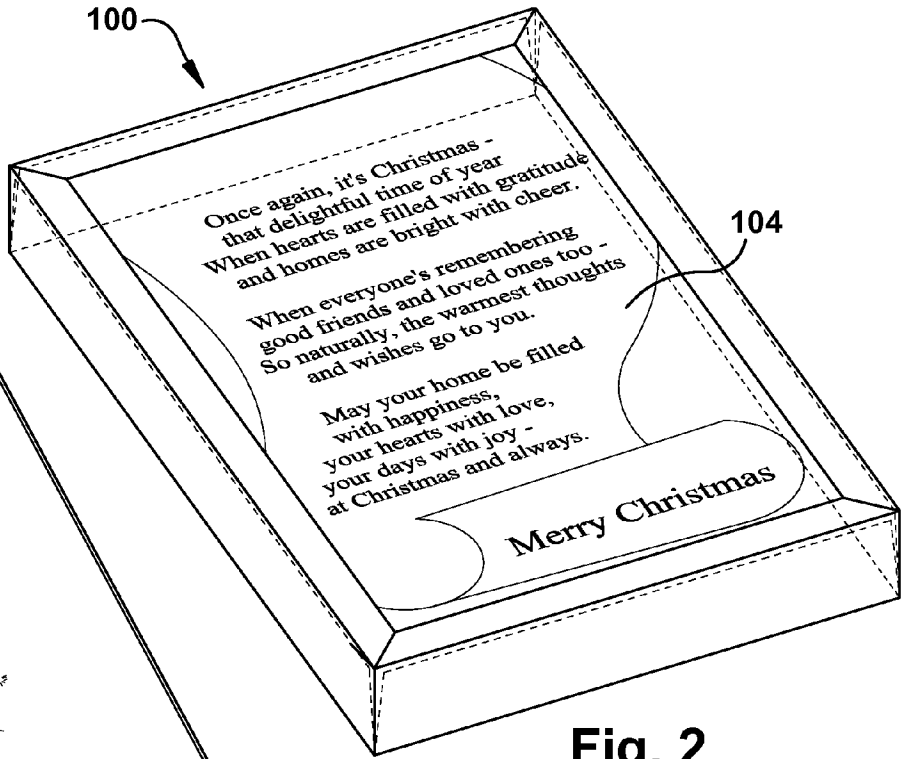
FIG. 2 is a back perspective view of the single frame box of FIG. 1.
Figure 1:
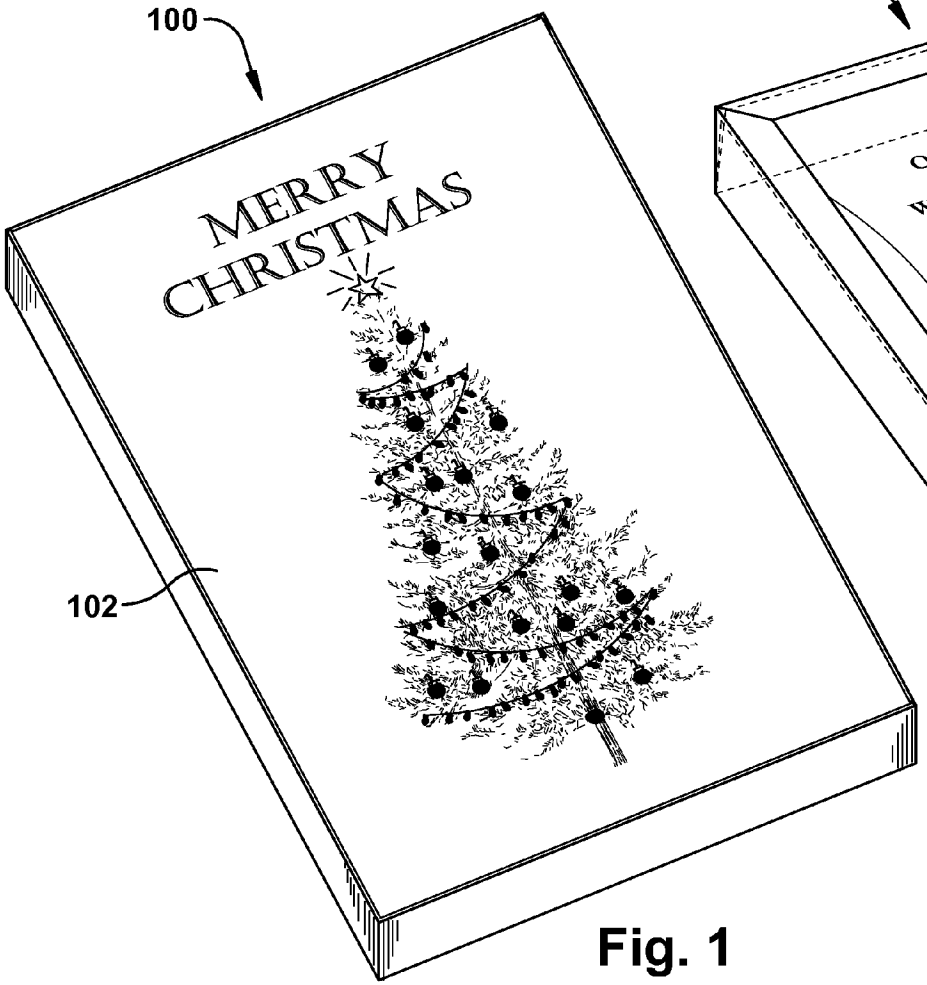
FIG. 1 is a front perspective view of a single frame box of the present invention.

The present invention and related disclosure pertains generally to containers or packaging for the retail sale of sets of greeting cards, and more particularly to a frame box type construction capable of holding, framing and displaying a plurality of greeting cards. FIG. 1 illustrates one embodiment of the frame box, also referred to herein as a single frame box 100, containing a plurality of greeting cards and envelopes stacked atop each other with the front face of the greeting card showing through the front side 102 of the single frame box 100. The entire front surface or a substantial portion of the front panel of the greeting card is visible through the open front of the frame box 100. FIG. 2 illustrates the substantially open back side 104 of the single frame box 100 where the inside panel of the greeting card (which may contain some verse or other graphics) is visible through the frame box by placing a two panel greeting card that is folded inside-out in the bottom of the box. Having both the front of the greeting card and the inside verse visible through the packaging eliminates the need for an extra label that is typically adhered to the outside of conventional greeting card boxes to display the inside sentiment, verse or text. It also allows consumers to view the actual front and inside panel of the greeting card as opposed to viewing a label facsimile showing the inside verse which may or may not be in the same color or contain any significant artwork. As used herein, the term 'package' refers to a container into which something may be packed. The term 'box' refers to a substantially square or rectangular structure used to house or at least partially surround contents. The term "frame box" refers generally to a structure which has four interconnected side walls, and which in certain alternate embodiments may also include flanges which extend from edges of the side walls. The term 'set' refers to a collection of like articles.

Another embodiment of the present disclosure and related inventions utilizes a single frame box 100 for holding, framing and displaying two sets of greeting cards. In this embodiment, the first set of greeting cards and corresponding envelopes are configured in a stacked arrangement so that the front cover of one greeting card is visible through the open front of the frame box 100. A second set of greeting cards and corresponding envelopes are also configured in a stacked arrangement and placed in a back-to-back configuration with the first set of greeting cards such that the front panel of the second set of greeting cards is visible through the substantially open back of the frame box 100.

Figure 3:
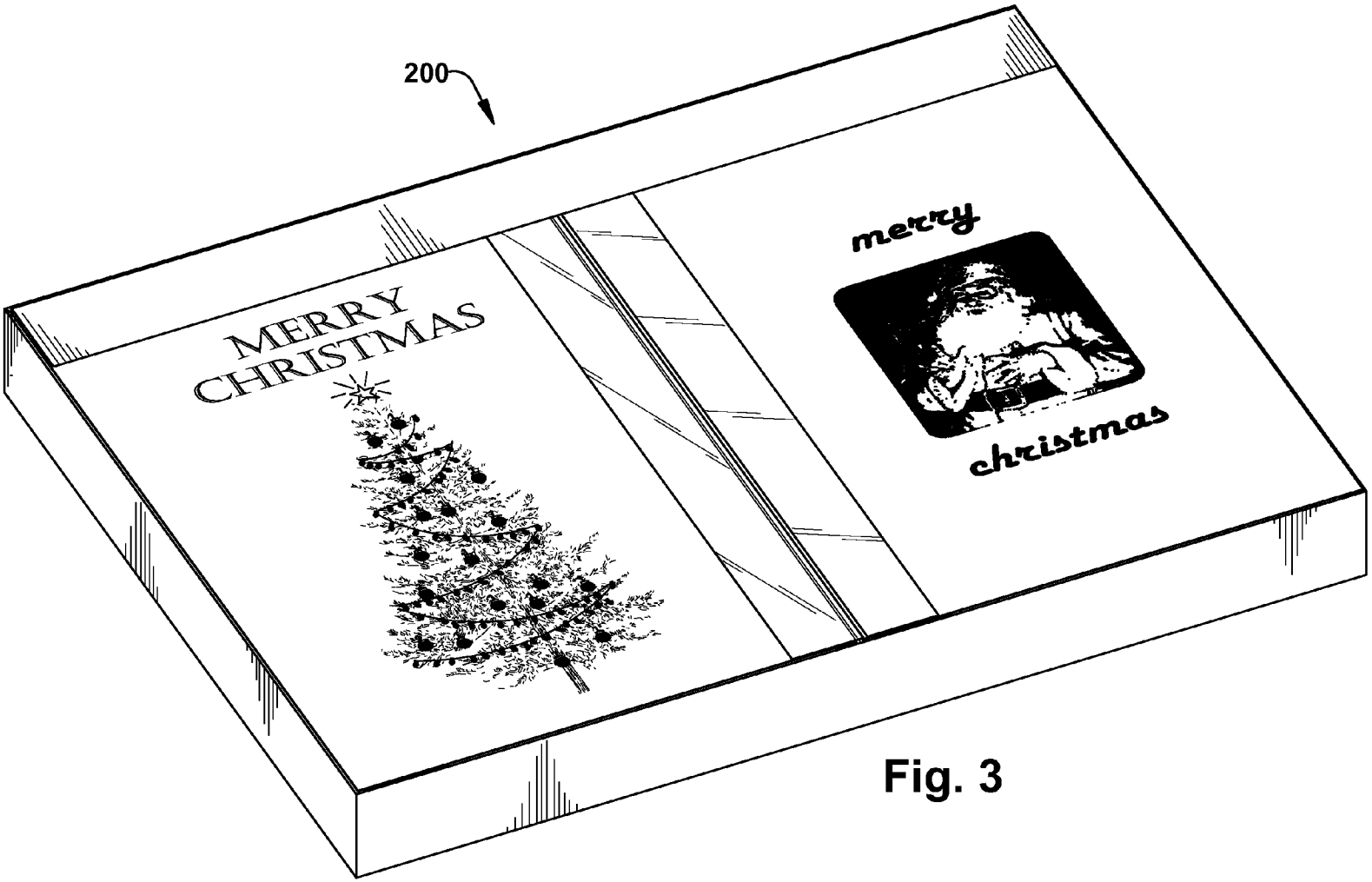
FIG. 3 is a front perspective view of a double frame box of the present invention.

Yet another embodiment of the present invention and related disclosure, referred to as the double frame box 200, is shown in FIG. 3. The double frame box 200 is able to accommodate two sets of greeting cards which are placed in a side by side arrangement. Similar to the single frame box, each of the two greeting card sets and the respective envelopes are stacked atop each other with the front face of each set of cards showing through the front face of the double frame box 200 and the inside verse of each of the two card sets showing through the back face of the double frame box 200.

Still another embodiment of the present invention utilizes the double frame box 200 for holding, framing and displaying four sets of greeting cards. A first and second set of greeting cards are placed side by side in a stacked arrangement so that the front covers of the first and second set of greeting cards are visible through the open front of the double frame box 200. The third and fourth set of greeting cards are also placed side by side in a stacked arrangement and placed back to back with the first and second set of greeting cards such that the front covers of the third and fourth sets of greeting cards are visible through the substantially open back of the double frame box 200.

Figure 4:
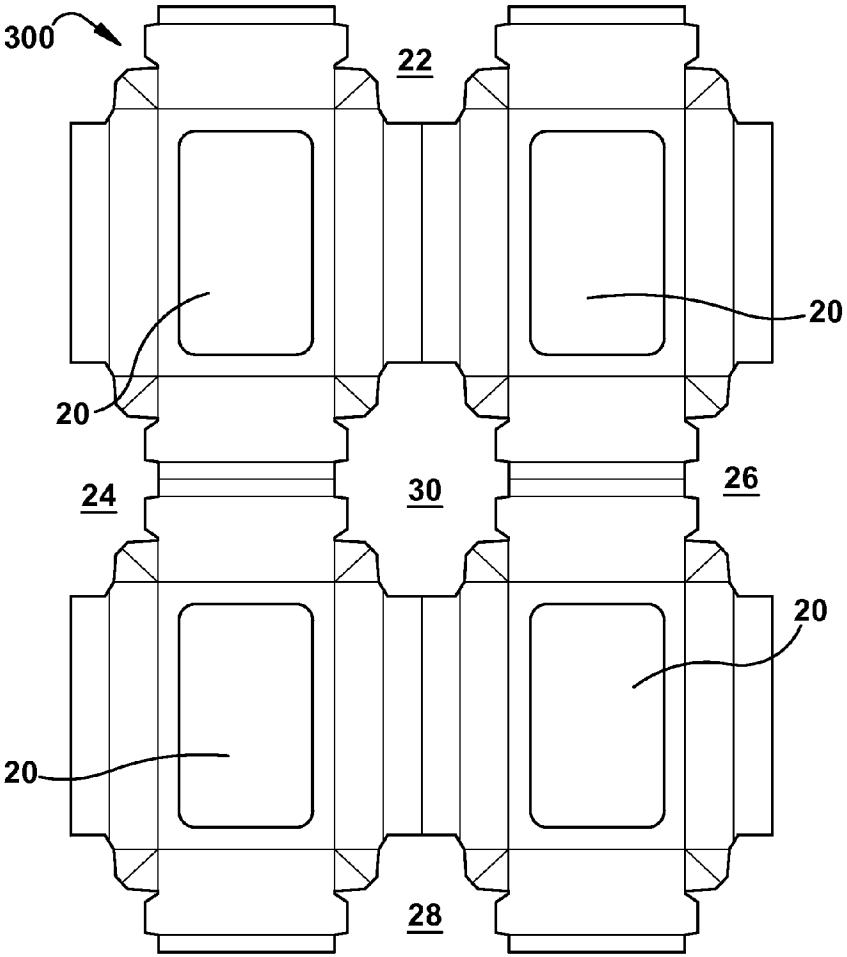
Fig. 4 (Prior Art)
FIG. 4 is a representative prior art 4-box manufacturing layout sheet.

One advantage of the present invention is that it requires less material than traditional greeting card boxes. In addition to requiring less material to produce, it also uses the material very efficiently and produces very little scrap. FIG. 4 shows a prior art 4-box manufacturing layout sheet 300. The intricate multi-shaped layout makes production and assembly quite complicated. The total area required to produce the prior art 4-box manufacturing layout sheet 300 is approximately 535.68 square inches and the total area of material required is 344.16 square inches. As shown in FIG. 4, the centers of each individual box 20, the perimeter indentions 22, 24, 26, 28 and the center of the layout sheet 30 all result in scrap material. The total scrap produced by the prior art frame box is 191.52 square inches. In other words, approximately 56% of the material required results in scrap.

Figure 5:
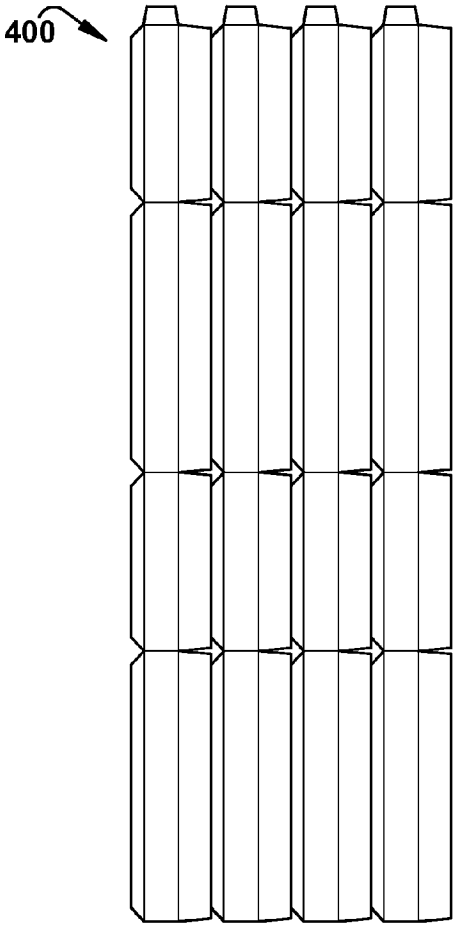
FIG. 5 is a representative 4-box manufacturing layout sheet.

On the other hand, FIG. 5 shows a representative 4-box manufacturing layout sheet of the frame box 400 of the present invention and related disclosure. As you can see, the layout of the present frame box 400 is of a substantially rectangular shape and contains minimal cut-outs or gaps in the required material. The total area and material required is also substantially less than is required from the prior art in FIG. 4. The total area required to produce a 4-box manufacturing layout sheet for the present disclosure is 234 square inches and the total area of material required is 228.12 square inches. The total scrap produced by the present disclosure is 5.88 square inches or approximately 3%. The present disclosure reduced the material required to produce the same number of greeting card boxes that are capable of housing the same number of greeting cards by 116.04 square inches and reduced the amount of scrap by over 50%. Reducing the amount of material required and the amount of scrap produced not only make the present disclosure more cost effective but also leads to less environmental harm. Additionally, the frame box, while reducing the necessary raw materials and environmental harm, maintains the strength of current industry standard greeting card boxes.

Figure 6:
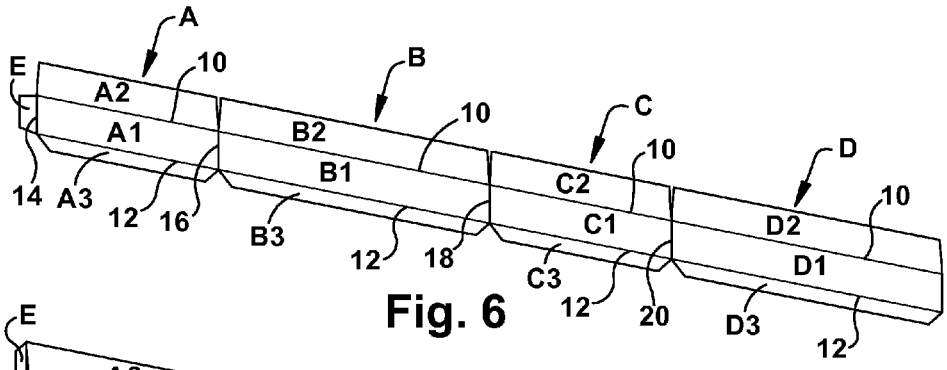
FIG. 6 is a perspective view of a die cut of a frame box.

FIG. 6 represents a die cut of a representative embodiment of a frame box of the present invention and related disclosure. The frame box may be made of cardboard, paperboard, corrugated board, scored plastic, corrugated plastic, molded plastic, or any other suitable material. The die contains four adjoining panels representing the top, bottom and two side panels of the box frame and also the top, bottom and two side flanges located at the back of the box frame. Each panel is connected to the adjacent panel along a fold line. Panel A includes of a main panel A1, an upper flange A2 and a lower flange A3. Panel A is connected to Panel B along fold line 16 and to a side tab E along fold line 14. The main panel A1 is connected to upper flange A2 along fold line 10 and to lower flange A3 along fold line 12. Panel B includes a main panel B1, an upper flange B2, and a lower flange B3. Panel B is connected to Panel C along fold line 18. The main panel B1 is connected to upper flange B2 along fold line 10 and to lower flange B3 along fold line 12. Panel C includes a main panel C1, an upper flange C2, and a lower flange C3. Panel C is connected to Panel D along fold line 20. The main panel C1 is connected to upper flange C2 along fold line 10 and to lower flange C3 along fold line 12. Panel D includes a main panel D1, an upper flange D2, and a lower flange D3. The main panel D1 is connected to upper flange D2 along fold line 10 and to lower flange D3 along fold line 12. A representative die cut, as shown in FIG. 6, is approximately 25.5 inches in length and 2.25 inches wide. In one particular embodiment, main panels A1 and C1, which represent the top and bottom of the frame, are approximately one inch long and approximately 5.1875 inches wide. Main panels B1 and D1, which represent opposing sides of the frame, are approximately 1 inch long and approximately 7.3125 inches wide. Side tab E is approximately 1 inch long and 0.5 inches wide.

Figure 7:
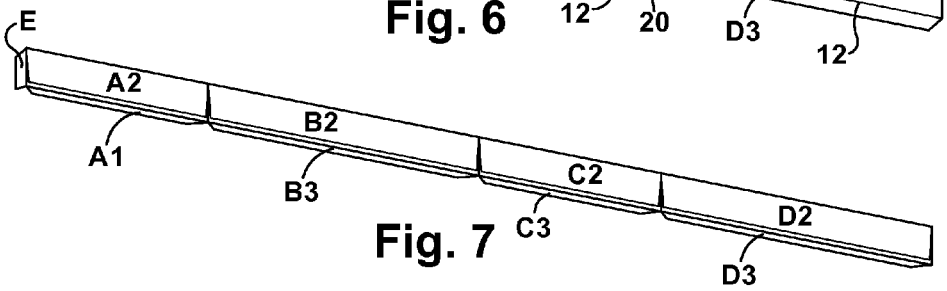
FIG. 7 is a perspective view of a frame box in the first stage of assembly.

The structure, construction and assembly of the frame box (both single frame box 100 and double frame box 200) from the die cut is illustrated in FIGS. 7-10. As shown in FIG. 7, each of the four panels A, B, C, D, is folded along fold line 10 so that the upper flanges A2, B2, C2, D2, are extended downward over the main panels A1, B1, C1, and D1. Side tab E is folded along fold line 14. The lower flanges A3, B3, C3 and D3 are folded upward along fold line 12 so that the lower flanges A3, B3, C3 and D3 are perpendicular to main panels A1, B1, C1 and D1 and upper flanges A2, B2, C2 and D2.

Figure 8:
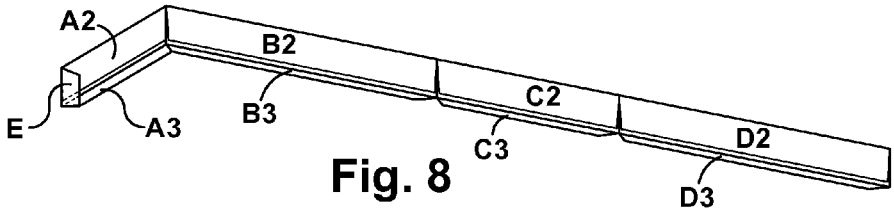
FIG. 8 is a perspective view of a frame box in the second stage of assembly.
Figure 9:
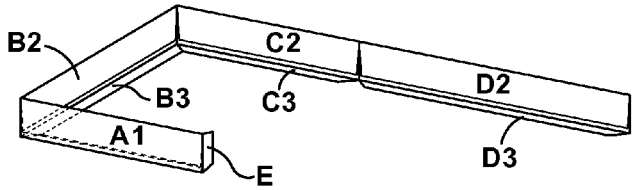
FIG. 9 is a perspective of a frame box in the third stage of assembly.
Figure 10:
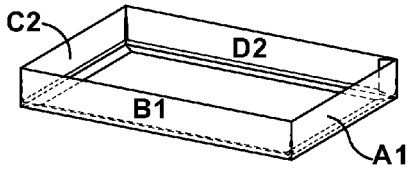
FIG. 10 is a perspective view of a frame box in the final stage of assembly.

Next, as shown in FIG. 8, Panel A is folded inward along fold line 16 such that Panel A is positioned perpendicular to Panels B, C, and D. FIG. 9 illustrates the next step, where Panel B is folded along fold line 18, positioning Panel A parallel to Panels C and D, and Panel B perpendicular to Panels A, C, and D. Finally, as shown in FIG. 10, the last step in assembling the frame box is folding Panel D along fold line 20 and attaching side tab E to the inside of Panel D using an adhesive or other attachment device. The lower flanges A3, B3, C3 and D3 create an L-shaped configuration with the main panels A1, B1, C1 and D1 producing a tray in which a set of greeting cards may be placed.

Figure 11:
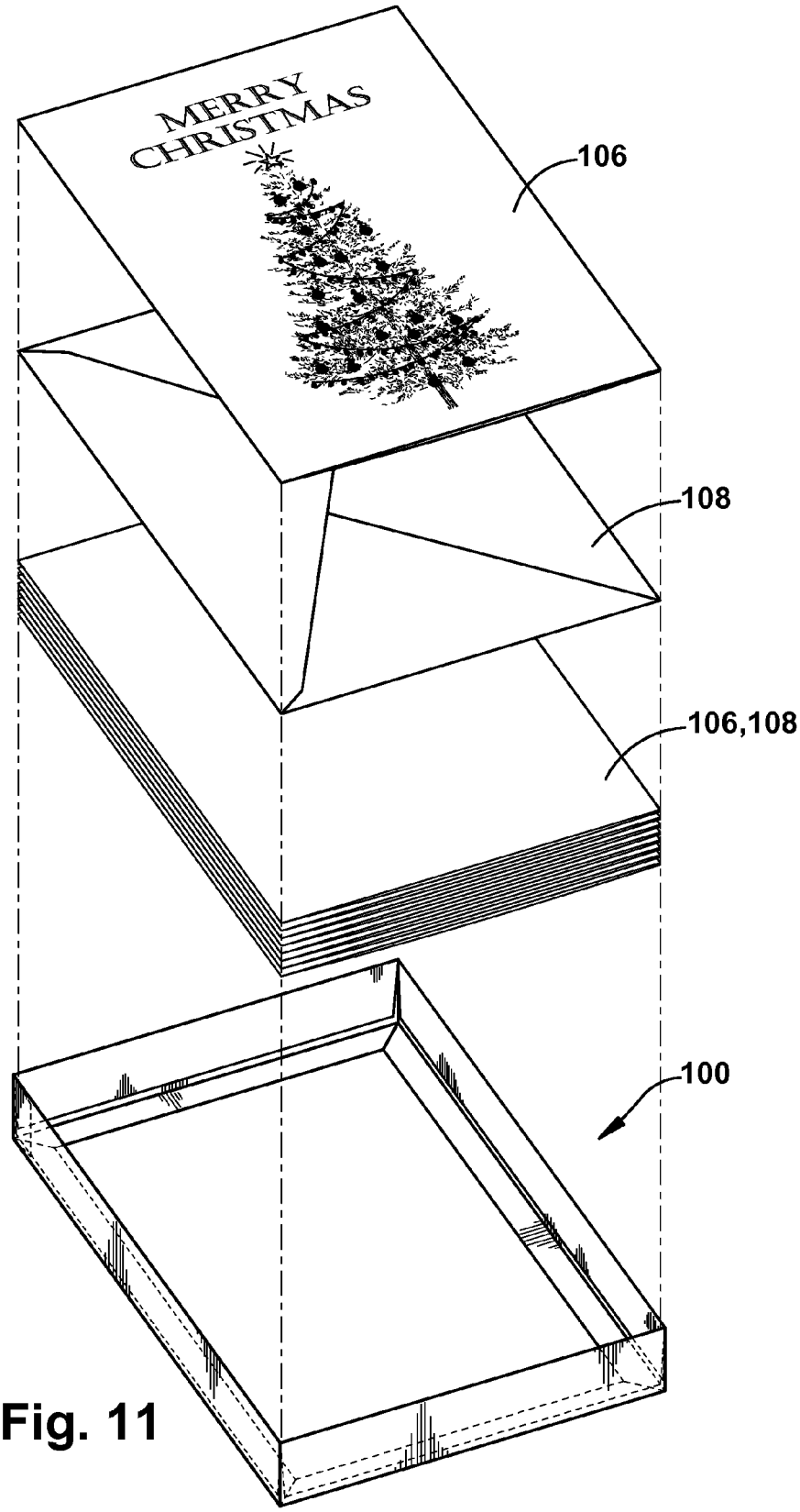
FIG. 11 is an exploded view of a frame box and its contents.

Once the frame is assembled, the cards and envelopes may be inserted. An exploded view of a single frame box 100 and the order of its contents are shown in FIG. 11. First, one greeting card 106 is folded backwards so that the inside verse of the greeting card is visible from the outside of the frame box 100. That greeting card 106 is placed into the box first, with the inside verse showing through the backside 104 of the box frame 100. The four edges of the greeting card are held inside the frame by the lower flanges A3, B3, C3, D3, which form an L-shape configuration with the upper, lower and two side panels of the frame box 100. The other greeting cards 106 are placed atop the backwards facing greeting card followed by the corresponding set of envelopes 108. A forward facing greeting card is placed on top of the stack so that the front face of the greeting card is visible through the front of the frame box 100. Once all greeting cards and envelopes have been inserted into the frame box, the entire structure is shrink-wrapped using cellophane or other suitable clear material so that the greeting cards are visible through both the front and back of the frame box 100.

Figure 12:
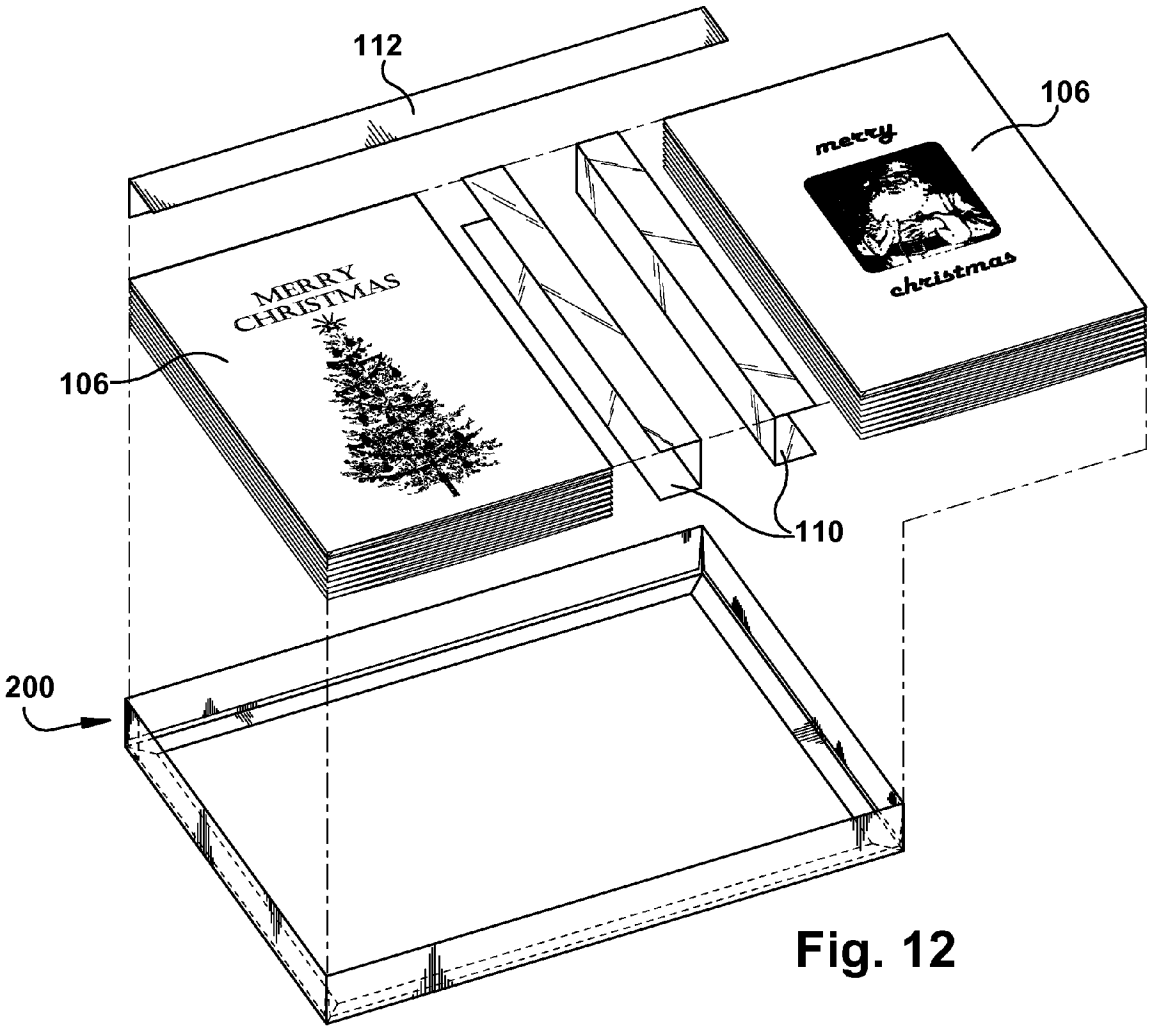
FIG. 12 is a perspective view of a double frame box with inserts.

There may be additional package inserts placed within the frame box for displaying product, manufacturing or price information and for, in the case of a double frame box 200, preventing sets of cards from intermingling. As shown in FIG. 12, a divider insert 110 and a graphic insert 112 is placed within the box assembly before the box is wrapped in cellophane. The graphic insert 112 is made of a paper-like material and is folded into an L-shape and placed over the top of the greeting cards 106 so that it slightly extends down over the top edge of the greeting cards 106. This insert may be used to display product, manufacturing or price information. The graphic inserts 112 are used with both the single card set frame box 100 and also the double card set frame box 200. The divider inserts 110 are used with double card frame boxes 200 to place a physical barrier between the two separate card sets. In a representative embodiment they are U-shaped and made of a plastic-like material, although other suitable materials may be used. Two divider insert 110 are placed back-to-back between two stacks of greeting cards 106 contained in a double card set frame box 200. Each set of cards fits into the channel created by the U-shaped configuration. The right edge of the card set placed in the left side of the frame box 200 are contained within a left divider insert and the left edge of the card set placed on the right side of the frame box 200 are contained within a right divider insert. The divider inserts 110 prevent the intermingling of cards during shipping.

The greeting card package structure frame box is a unique, useful, and cost-effective alternative to the traditional greeting card box. The package structure frame box allows consumers to view both the front cover and inside verse of the greeting card before making a purchase. Also, from a cost perspective, the package structure frame box requires less material to manufacture than is used in a traditional greeting card box design. Not only does the minimization of material result in cost savings, but it also results in less waste resulting in less harm to the environment.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

What is claimed is:

1. A greeting card package assembly comprising:

a frame box having at least four adjoining side panels configured to form a polygonal shaped structure, each adjoining side panel having a flange which extends therefrom, the frame box having a completely open front and a substantially open back between the side panels and the flanges;

a plurality of greeting cards in a stacked arrangement within the frame structure, each greeting card having a front cover and an inside page, the front cover being exposed through the completely open front of the frame box;

a plurality of greeting card envelopes in a stacked arrangement within the frame structure proximate to the plurality of greeting cards; and a transparent enclosure which substantially surrounds the frame box and extends over the completely open front and the substantially open back;

wherein the plurality of greeting cards include a first set of identical greeting cards and a second set of identical greeting cards, a front cover of the second set of identical greeting cards being visible through the substantially open back of the box frame.

2. The greeting card package assembly of claim 1, further comprising a graphic insert positioned over a top edge of the plurality of greeting cards and extending over a top portion of a first greeting card in the stacked arrangement and visible through the completely open front of the frame box.

3. The greeting card package assembly of claim 1, wherein the first and second sets of greeting cards are placed in a side by side arrangement, the front cover of the first and second set of greeting cards is visible through the completely open front of the frame box and an inside page of the first and second sets of greeting cards is visible through the substantially open back of the frame box.

4. The greeting card package assembly of claim 3 further comprising two divider inserts that are placed in between the first and second sets of greeting cards.

5. The greeting card package assembly of claim 1, wherein the polygonal shaped structure of the frame box is made of cardboard, paper board, corrugated board, scored plastic, corrugated plastic, or molded plastic.

6. A greeting card package assembly comprising:

a frame box having at least four adjoining side panels configured to form a polygonal shaped structure, each adjoining side panel having a flange which extends therefrom, the frame box having a completely open front and a substantially open back between the side panels and the flanges;

a plurality of greeting cards in a stacked arrangement within the frame structure, each greeting card having a front cover and an inside page, the front cover being exposed through the completely open front of the frame box;

a plurality of greeting card envelopes in a stacked arrangement within the frame structure proximate to the plurality of greeting cards; and a transparent enclosure which substantially surrounds the frame box and extends over the completely open front and the substantially open back;

wherein the plurality of greeting cards include a first set of identical greeting cards, a second set of identical greeting cards, a third set of identical greeting cards and a fourth set of identical greeting cards, and wherein a front cover the first and second set of identical greeting cards is visible through the completely open front of the frame box and a front cover of the third and fourth sets of identical greeting cards is visible through the substantially open back of the frame box.

* * * * *